US008342263B2

(12) United States Patent
Kejr et al.

(10) Patent No.: US 8,342,263 B2
(45) Date of Patent: Jan. 1, 2013

(54) VIBRATORY DRILL HEAD MOUNTING AND ROTATION COUPLING SYSTEM

(75) Inventors: Brent Kejr, Salina, KS (US); Ryan Kejr, Salina, KS (US)

(73) Assignee: Kejr, Inc., Salina, KS (US)

( * ) Notice: Subject to any disclaimer, the term of this patent is extended or adjusted under 35 U.S.C. 154(b) by 342 days.

(21) Appl. No.: 12/631,443

(22) Filed: Dec. 4, 2009

(65) Prior Publication Data

US 2010/0139985 A1 Jun. 10, 2010

Related U.S. Application Data

(60) Provisional application No. 61/121,363, filed on Dec. 10, 2008.

(51) Int. Cl.
*E21B 7/24* (2006.01)

(52) U.S. Cl. ..... 175/56; 175/135; 175/189; 173/49; 173/213; 173/210

(58) Field of Classification Search ..... 175/56, 175/135, 189; 173/49, 210, 211, 213
See application file for complete search history.

(56) References Cited

U.S. PATENT DOCUMENTS

| | | | | |
|---|---|---|---|---|
| 2,648,958 A | | 8/1953 | Schlotmann | |
| 3,362,485 A | * | 1/1968 | Dyer, Sr. | 173/49 |
| 3,379,263 A | | 4/1968 | Bodine, Jr. | |
| 3,394,766 A | * | 7/1968 | Lebelle | 173/49 |
| 3,468,138 A | | 9/1969 | Downey | |
| 4,553,443 A | | 11/1985 | Rossfelder et al. | |
| 4,645,017 A | | 2/1987 | Bodine | |
| 5,027,908 A | | 7/1991 | Roussy | |
| 5,409,070 A | | 4/1995 | Roussy | |
| 5,771,985 A | * | 6/1998 | Jaworski | 175/55 |

(Continued)

FOREIGN PATENT DOCUMENTS

JP 2006-125121 A 5/2006

OTHER PUBLICATIONS

PCT International Search Report and Written Opinion dated Jul. 13, 2010, for Applicant's corresponding International Application No. PCT/US2009/067492.

*Primary Examiner* — Giovanna Wright
*Assistant Examiner* — Richard Alker
(74) *Attorney, Agent, or Firm* — Jeffrey L. Thompson; Thompson & Thompson, P.A.

(57) ABSTRACT

A mobile drill rig has a drill mast, a carriage mounted to the drill mast for vertical movement, and a vibratory drill head having a sine generator and a rotation mechanism for imparting vibration and rotation to a drill rod string. An elastomeric torsion coupler couples the rotation mechanism to the sine generator to transmit rotational force to the drill rod string while isolating vibrations of the sine generator from the rotation mechanism. Another coupler connects the drill head to the carriage in a manner that allows floating vertical movement of the drill head relative to the carriage while isolating vibrations of the sine generator from the carriage. Elastomeric bumpers limit the vertical movement of the drill head relative to the carriage. Elastomeric spacers located between the rotation mechanism and the sine generator handle the vertical loading and maintain the proper spacing between the sine generator and the rotation mechanism.

28 Claims, 6 Drawing Sheets

U.S. PATENT DOCUMENTS

| | | | | |
|---|---|---|---|---|
| 5,910,049 | A | 6/1999 | DeWachter et al. | |
| 6,129,159 | A | 10/2000 | Scott et al. | |
| 6,739,410 | B2 | 5/2004 | Smith et al. | |
| 7,217,193 | B2 | 5/2007 | Nisley | |
| 7,607,498 | B2 | 10/2009 | Roussy | |
| 2006/0225922 | A1 * | 10/2006 | Pfahlert | 175/56 |
| 2007/0151377 | A1 | 7/2007 | Roussy | |
| 2010/0089653 | A1 * | 4/2010 | Oothoudt et al. | 175/107 |

* cited by examiner

VIBRATORY DRILL HEAD MOUNTING AND ROTATION COUPLING SYSTEM

RELATED APPLICATIONS

This application claims priority of U.S. Provisional Application No. 61/121,363 filed on Dec. 10, 2008. The entire content of this prior application is incorporated herein by reference.

BACKGROUND OF THE INVENTION

1. Field of the Invention

This invention relates generally to mobile drill rigs for advancing drill rods into the ground and retracting drill rods from the ground. In particular, the present invention relates to a mounting and rotation coupling system for a vibratory drill head for use on a mobile drill rig.

2. Description of the Related Art

A mobile drill rig can be used for many tasks, including: soil core and soil gas sampling, groundwater sampling and testing, geo-technical investigation, geothermal ground loops installation, contaminant logging, grouting, and materials injection. A typical configuration consists of a power unit, drill mast, positioning features (movement fore and aft, drill mast tilt, outriggers, and so forth), drill head, and support hardware (pumps, winch, etc.).

A vibratory drill head is one common technique used for advancing tooling (or "drill string") into the ground. A typical vibratory drill head (also commonly referred to as a sonic drill head) includes a sine generator as well as a rotation mechanism to rotate the drill spindle. The sine generator imparts vertical vibrations to the drill string it is coupled to, while the rotation mechanism provides the necessary rotation of the drill string. Typical vibratory drill heads operate between 50-200 Hz. Those knowledgeable in the art recognize the elements necessary to produce the vibratory forces from the sine generator. Therefore a detailed explanation of the components and operating principles will not be described herein. Notable variations of vibratory drill heads are described in U.S. Pat. Nos. 3,379,263, 4,553,443, 6,129,159, and 6,739,410, which are incorporated herein by reference.

Harnessing the vibratory forces created from the sine generator has proven difficult. Many unsuccessful attempts have been made to isolate the drill head carriage, rotation mechanisms, and drive components from the sine generator through complex linkages and metal-to-metal sliding contacts. Premature component failure is greatly increased when improper isolation of the sine generator is not achieved.

Prior methods to connect the rotary motion from the rotation mechanism to the sine generator have been explored. One method, as described in U.S. Pat. No. 6,739,410, includes metal-to-metal sliding contacts with forced lubrication at the surface interface. Another method, as described in U.S. Pat. No. 5,409,070, uses blade-like projections and corresponding spaced apart faces positioned radially around the sine generator. These provide vertical movement of the drill string to accommodate the vibrations imparted from the sine generator as well as rotation confinement. However, all current methods for transferring rotary motion to the drill string while coupled to the sine generator are complicated and maintenance intensive.

In addition, prior methods to allow the vibratory drill head to displace vertically have been limited to short distances. One method, as described in U.S. Pat. No. 6,739,410, uses precision disc springs to isolate the vibration forces from the rest of the drill head. Another method, as described in U.S. Pat. No. 5,409,070, uses a pneumatic spring integral to the drill head that acts to cushion the vibration forces. Other methods include the use of a plurality of plate mount shear isolators (sandwich isolators) that allow for minimal vertical displacement. All of the abovementioned methods attempt to keep the drill spindle in a "neutral" position. However, when coupling on and off of the drill string it is desirable to have a drill head that will displace vertically and "float." This allows the vibratory drill head to couple on and off of the drill string without any preloading of either the drill string or the vibratory drill head.

Therefore, there is a need for an improved mounting system for the components of the vibratory drill head to increase component life and maximize drilling efficiency.

SUMMARY OF THE INVENTION

An object of the present invention is to provide an improved mounting and rotation coupling system for a vibratory drill head of a mobile drill rig.

A further object of the present invention is to provide a flexible elastomeric coupling between the sine generator and the rotation mechanism of a vibratory drill head.

A further object of the present invention is to provide a mounting system for a vibratory drill head that isolates the rotation mechanism from vibrations from the sine generator without using a metal-to-metal sliding contact.

A further object of the present invention is to provide a mounting system for a vibratory drill head that has a flexible elastomeric coupling between a sine generator and a rotation mechanism, and a separate arrangement of elastomeric spacers for maintaining a position of the rotation mechanism relative to the sine generator and to provide vertical displacement of the rotation mechanism.

A further object of the present invention is to provide a mounting system for a vibratory drill head that allows vertical displacement of the vibratory drill head relative to a drill head carriage, vibration isolation of the sine generator, bumpers for limiting vertical displacement (top and bottom) of the vibratory drill head by acting on the sine generator, and that accommodates misalignment between the drill rod string centerline and the drill mast.

To accomplish these and other objects of the present invention, a vibratory drill head mounting system is provided, comprising: a drill head carriage; a vibratory drill head; and an elastomeric isolator that connects the vibratory drill head to the drill head carriage. The elastomeric isolator provides an interface that allows vertical displacement of the drill head relative to the carriage, isolates vibrations of the drill head from the drill head carriage, and accommodates misalignment between the drill head carriage and a drill rod string.

According to another aspect of the present invention, a vibratory drill head mounting system is provided, comprising: a drill head carriage; and a vibratory drill head having a sine generator and a rotation mechanism for imparting vibration and rotation to a drill rod string. A first means couples the rotation mechanism to the sine generator to allow rotational force to be imparted by the rotation mechanism to the drill rod string while isolating vibrations of the sine generator from the rotation mechanism. A second means couples the drill head to the drill head carriage to allow floating vertical movement of the drill head relative to the drill head carriage in a vertical direction while isolating vibrations of the sine generator from the drill head carriage.

According to another aspect of the present invention, a drill head mounting system is provided for a mobile drill rig, comprising: a drill head carriage having first and second vertically aligned parallel rods; a vibratory drill head having a sine generator and a rotation mechanism for imparting vibration and rotation to a drill rod string; a flexible elastomeric torsion coupling; and first and second elastomeric isolator assemblies. The elastomeric torsion coupling has a first attachment structure associated with the rotation mechanism, a second attachment structure associated with the sine generator, and an annular elastomeric flexible torsion element interconnecting the first and second attachment structures for transmitting rotational force to the drill rod string while isolating vibrations of the sine generator from the rotation mechanism. The first and second elastomeric isolator assemblies each have an outer structure connected to the sine generator, an inner structure slidably connected to a respective one of the first and second rods, and an elastomeric member connecting the inner and outer structures for allowing floating movement of the drill head relative to the carriage in a vertical direction while isolating vibrations of the sine generator from the carriage.

Numerous other objects of the present invention will be apparent to those skilled in this art from the following description wherein there is shown and described an embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the present invention is made with reference to the accompanying drawings.

In the drawings.

DETAILED DESCRIPTION OF THE INVENTION

A mounting system for a vibratory drill head of a mobile drill rig according to the present invention will be described in detail with reference to FIGS. 1 to 7 of the accompanying drawings.

Figure 1:
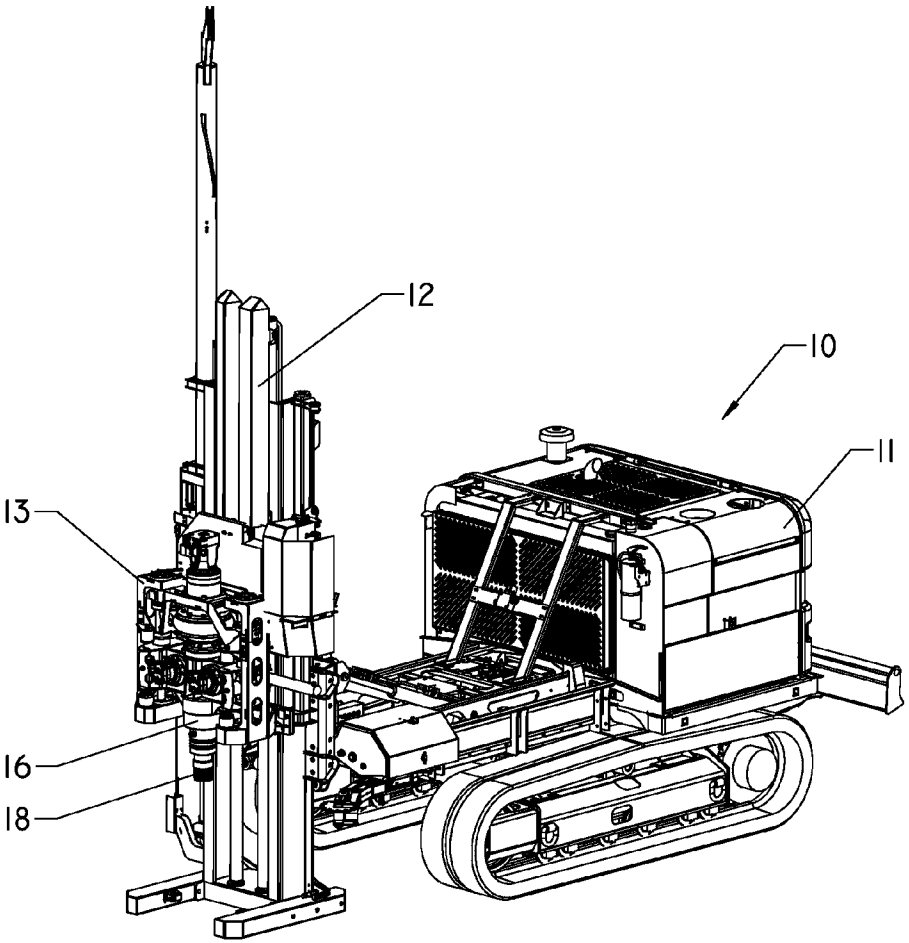
FIG. 1 is a perspective view of a representative mobile drill rig with a vibratory drill head equipped with the mounting system according to the present invention.
Figure 2:
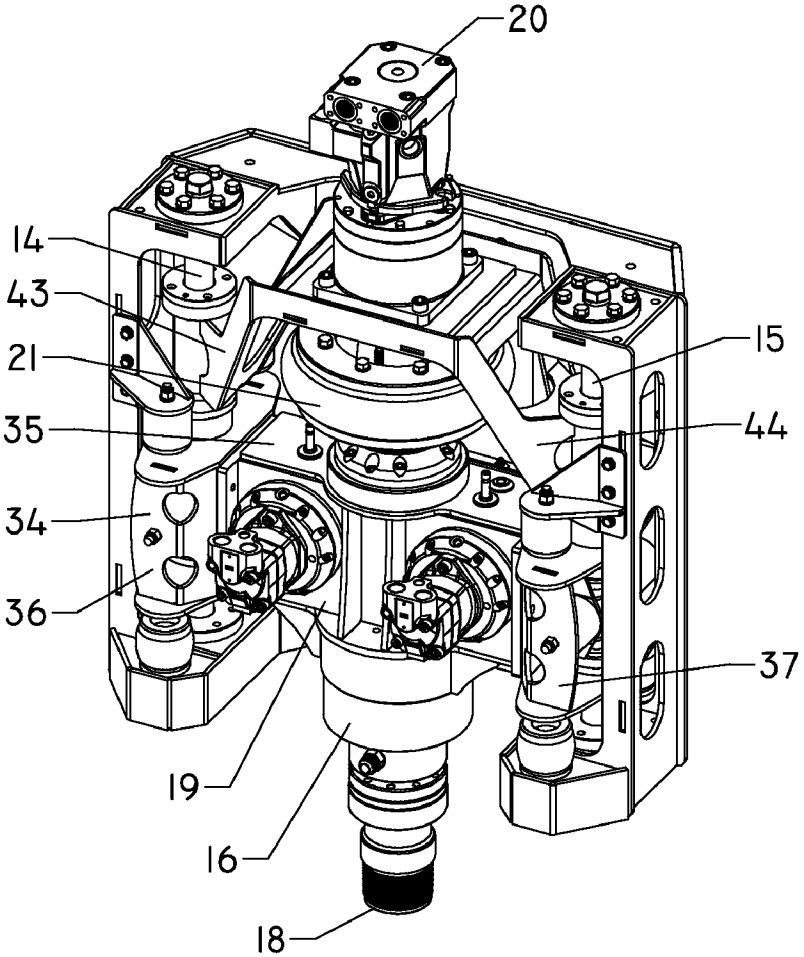
FIG. 2 is a perspective view of a vibratory drill head with a mounting system according to the present invention.
Figure 3:
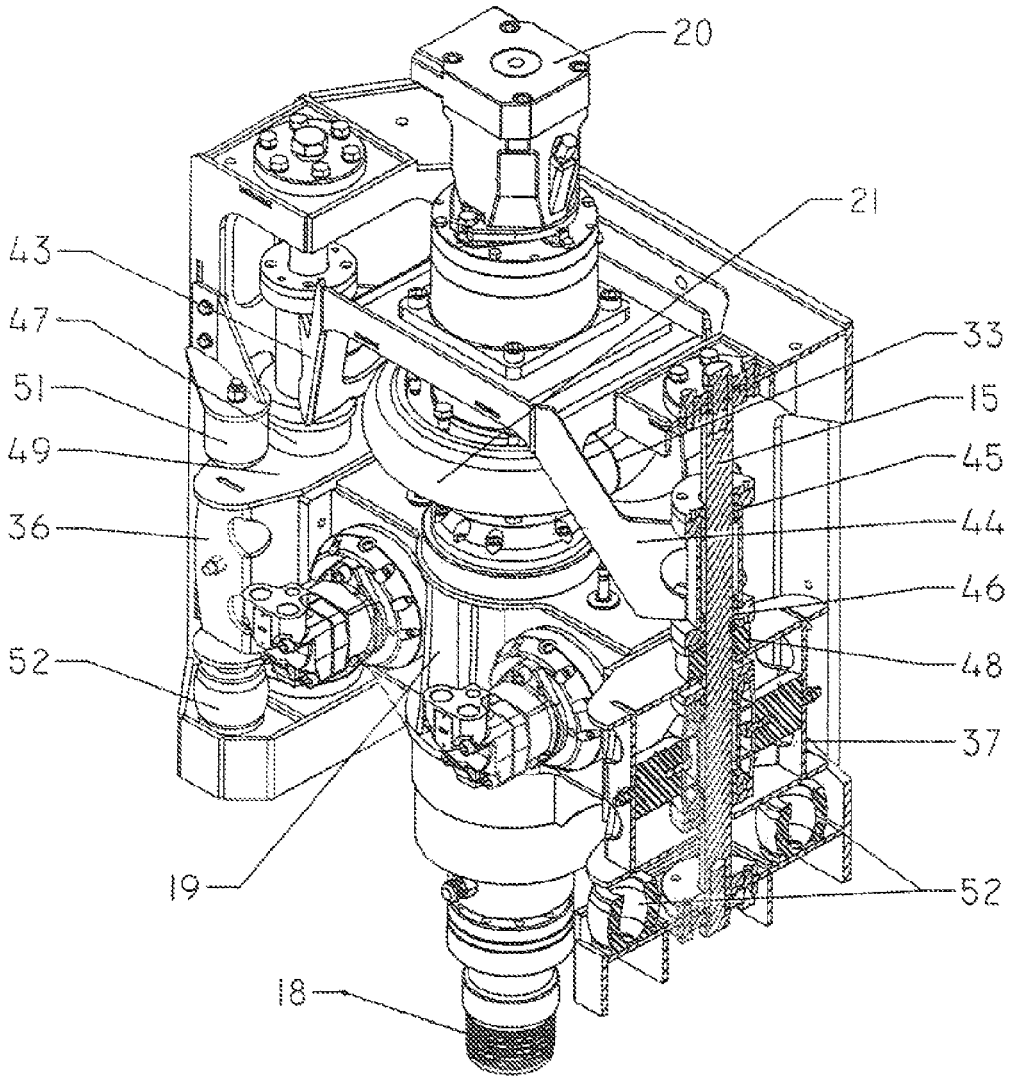
FIG. 3 is a cross section perspective view of a vibratory drill head with a section drawn through one of the vertical slide rods of the drill head carriage.

A mobile drill rig 10 for advancing tooling into the ground is shown in FIG. 1. The drill rig 10 includes a power unit 11, a drill mast 12, a mechanism for tilting the drill mast 12 and moving the mast fore and aft, and a carriage 13 mounted on the drill mast 12. The carriage 13 is slidable in a vertical direction along the drill mast 12, and is also slidable from side-to-side in a horizontal direction relative to the drill mast 12. Hydraulic actuators are provided to move the carriage 13 along the drill mast 12 and for sliding the carriage 13 from side-to-side in a known manner.

A pair of vertically aligned parallel rods 14, 15 are rigidly fixed at their ends to the drill head carriage 13. A drill head 16 is mounted on the parallel rods 14, 15. The drill head 16 includes a sine generator 19 and a rotation mechanism 20 for driving a threaded connection 18 that couples with a plurality of drill rods ("drill rod string"; not shown) into the ground. The sine generator 19 creates vibrations in a vertical direction, which are imparted to the drill rod string via the threaded connection 18 to help advance the drill rod string (not shown) into the ground.

The rotation mechanism 20 is positioned above the sine generator 19 and is used to impart rotation to the drill rod string via the threaded connection 18, which also helps advance the drill rod string into the ground. The sine generator 19 and the rotation mechanism 20 are allowed to displace vertically and float on the parallel vertical rods 14, of the carriage 13.

A first coupling system 21 is provided for coupling the rotation mechanism 20 to the sine generator 19. The first coupling system 21 allows rotational force to be imparted by the rotation mechanism 20 to the drill rod string via a vertical shaft 26 and the threaded connection 18 at the lower end of the vertical shaft 26, while isolating vibrations of the sine generator 19 from the rotation mechanism 20. The vertical shaft 26 extends vertically through the sine generator 19 and is supported near its upper end by a roller bearing **26*a* and near its lower end by first and second taper bearings 26*b*, 26*c*. The first and second taper bearings 26*b*, 26*c* are arranged to transmit vertical vibrations from the sine generator 19 into the vertical shaft 26**.

The first coupling system 21 includes a first attachment structure 23 associated with the rotation mechanism 20, and a second attachment structure 24 associated with the vertical shaft 26. An annular elastomeric flexible torsion element 25 interconnects the first and second attachment structures 23, 24 to allow rotational force from the rotation mechanism 20 to be transferred to the vertical shaft 26 for driving the threaded connection 18 and the drill rod string. The torsion element 25 is secured to the first and second attachment structures 23, 24 with clamping assemblies 27, 28 that clamp against the side wall edges 29, 30 of the flexible torsion element 21. Threaded bolts 31, 32 or the like are used to force the clamping assemblies 27, 28 against the side wall edges 29, 30.

Figure 4:
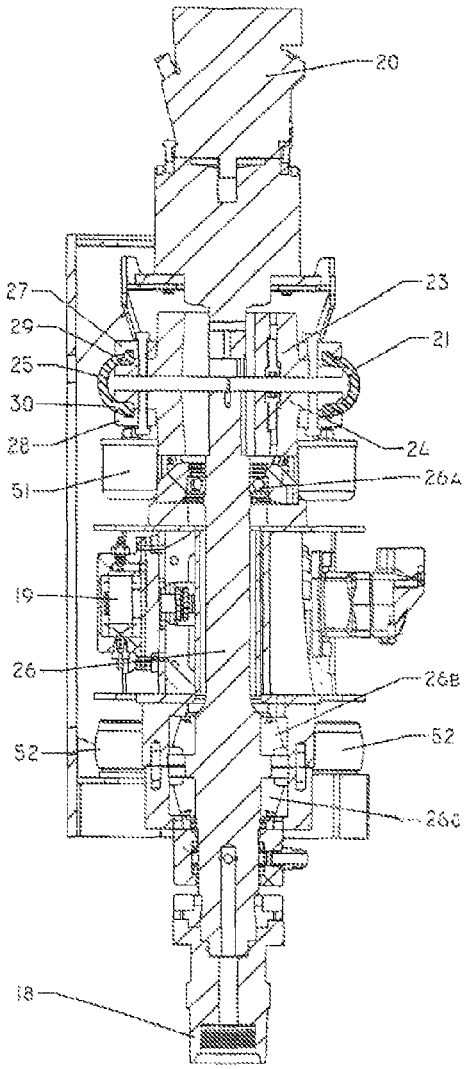
FIG. 4 is a cross section side view of the vibratory drill head with the section through the center drill spindle.
Figure 5:
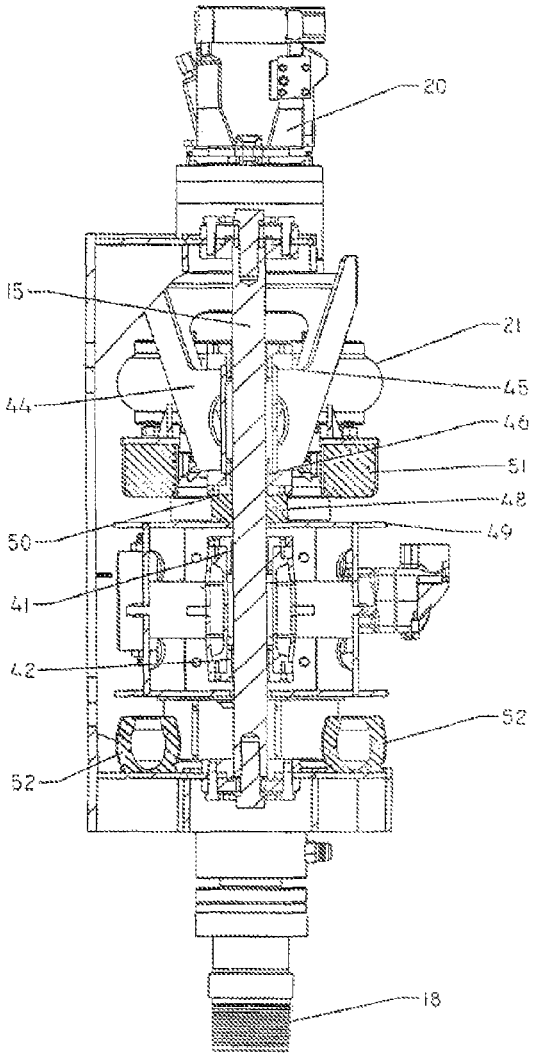
FIG. 5 is a cross section side view of the vibratory drill head with the section through one of the vertical slide rods of the drill head carriage.
Figure 6:
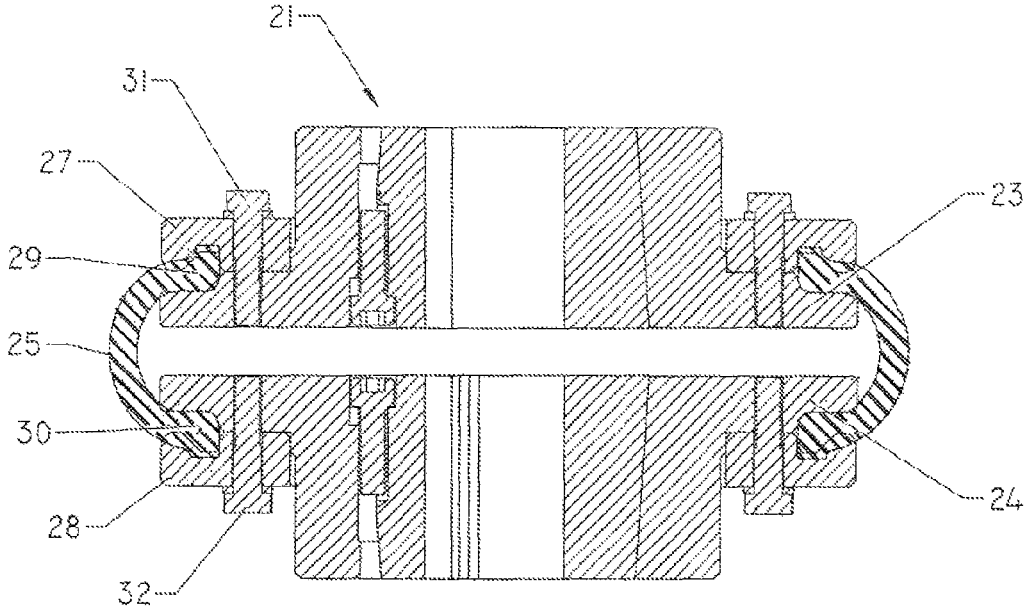
FIG. 6 is a cross section elevation view of a flexible elastomeric torsion coupling of the mounting system according to the present invention.
Figure 7:
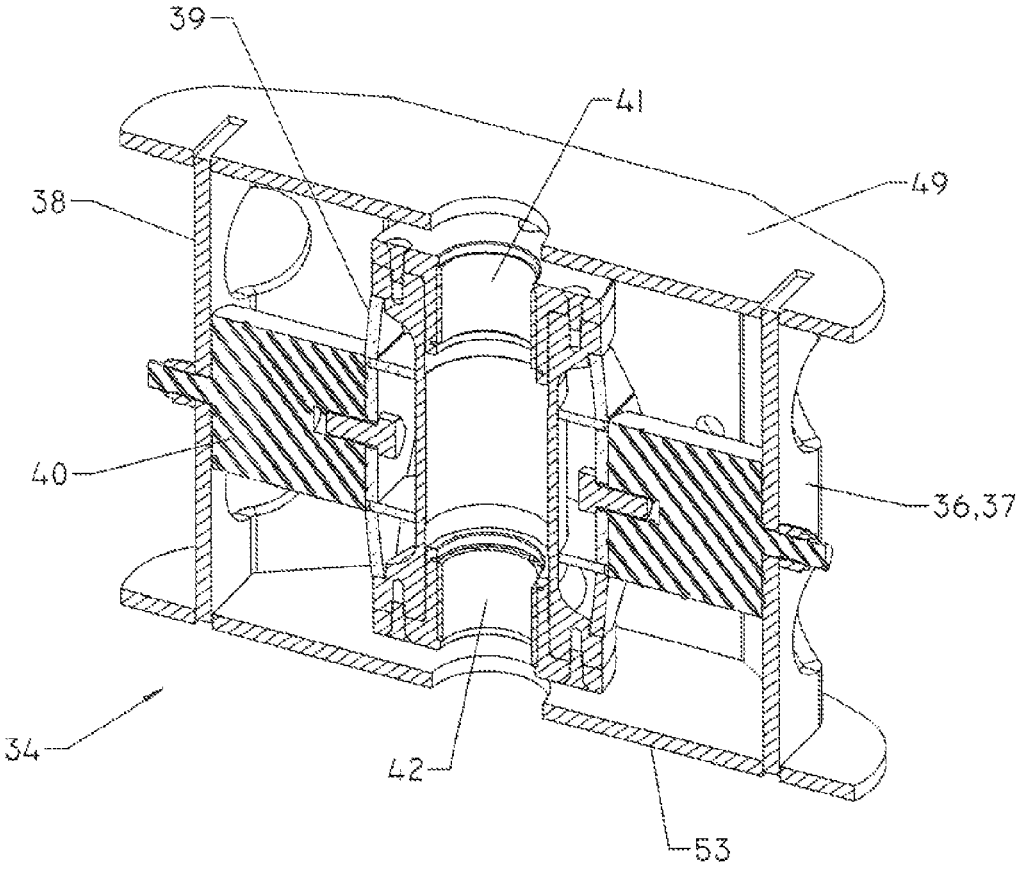
FIG. 7 is a cross section perspective view of a sine generator isolation mount used in the vibratory drill head.

The flexible torsion element 25 comprises an annular body of elastomeric material. The annular body 25 has a generally arcuate transverse cross sectional shape and radially inwardly extending side walls, as shown in FIGS. 4 and 6. An axial split 33 extends through the annular body 25 in an axial direction to facilitate installation and removal of the annular body 25 from the first and second attachment structures 23, 24.

Flexible elastomeric torsion couplings suitable for use in the present invention are known in the prior art. For example, U.S. Pat. Nos. 2,648,958, 3,468,138 and 5,910,049 disclose flexible torsion couplings for connecting two disjoined shafts in an end-to-end, axially aligned relation. The contents of these prior patents are incorporated herein by reference.

A second coupling system 34 is provided for connecting the housing 35 of the sine generator 19 to the drill head carriage 13. The second coupling system 34 allows floating vertical movement of the drill head 16 relative to the carriage 13 in a vertical direction, while isolating vibrations of the sine generator 19 from the carriage 13. The second coupling system 34 includes first and second elastomeric isolator assemblies 36, 37 coupled with the parallel vertical rods 14, 15 of the carriage 13. The elastomeric isolator assemblies 36, 37 each have an outer structure 38 connected to or integral with the housing 35 of the sine generator 19, an inner structure 39 slidably connected to a respective one of the vertical rods 14, 15 of the carriage 13, and at least one elastomeric member 40 connecting the inner and outer structures 38, 39. In the illustrated embodiment, two elastomeric members 40 connect the inner and outer structures 38, 39. The inner structure 39 of each elastomeric isolator assembly 36, 37 includes at least one, and preferably two, journal bearings 41, 42 that allow the elastomeric isolator assemblies 36, 37 to slide along a respect one of the vertical rods 14, 15.

The elastomeric isolator assemblies 36, 37 allow floating movement of the drill head 16 relative to the carriage 13 in a vertical direction. The floating movement is provided by the journal bearings 41, 42 within the elastomeric isolator assemblies 36, 37 sliding along the vertical rods 14, 15, which are fixed on the carriage 13. The elastomeric isolator assemblies 36, 37 also isolate vibrations of the sine generator 19 from the drill head carriage 13, and accommodate misalignment between the drill mast 12 and the centerline of the drill rod string. Without this misalignment capability, unequal loading and premature failure of the journal bearings 41, 42 would result.

The rotation mechanism 20 also includes first and second stabilizer arms 43, 44 coupled with the parallel vertical rods 14, 15 of the carriage 13. The stabilizer arms 43, 44 each have at least one, and preferably two, journal bearings 45, 46 that allow vertical sliding movement of the stabilizer arms 43, 44 along a respective one of the vertical rods 14, 15.

The flexible elastomeric torsion coupling 21 does not carry any of the vertical loading imparted by the rotation mechanism 20 or the sine generator 19. The vertical loading is carried by elastomeric spacers 47, 48 placed between the top sides 49 of the elastomer isolator assemblies 36, 37 and the bottom sides 50 of the stabilizer arms 43, 44. The elastomeric spacers 47, 48 are concentric with the vertical rods 14, 15 and slide with the elastomer isolator assemblies 36, 37 along the vertical rods 14, 15. The elastomeric spacers 47, 48 support the rotation mechanism 20 on top of the sine generator 19, and also maintain a proper spacing between the sine generator 19 and the rotation mechanism 20.

A plurality of elastomeric bumpers 51, 52 are mounted to the drill head carriage 13 for confining the vertical movement of the drill head 16 within upper and lower limits along the parallel rods 14, 15. A first set of bumpers 51 are arranged to engage the top side 49 of the isolator assemblies 36, 37, and a second set of bumpers 52 are arranged to engage a bottom side 53 of the isolator assemblies 36, 37.

The interface provided by the isolator assemblies 36, 37 confines the vertical movement of the sine generator 19 within the length of the parallel rods 14, 15 while providing the necessary vibration isolation and vertical displacement. The isolator assemblies 36, 37 also allow the sine generator 19 to accommodate misalignment of the drill string centerline relative to the alignment of the drill mast 12, as explained above.

The mounting system of the present invention provides the advantages of: (1) isolating the drill head 16 from the drill head carriage 13; (2) isolating the sine generator 19 from the rotation mechanism 20; (3) allowing for vertical displacement of the vibratory drill head 16 relative to the drill head carriage 13 for ease of coupling on and off the drill rod string; and (4) accommodating any misalignment of the drill rod string centerline relative to the drill mast 12.

While the invention has been specifically described in connection with specific embodiments thereof, it is to be understood that this is by way of illustration and not of limitation, and the scope of the appended claims should be construed as broadly as the prior art will permit.

What is claimed is:

1. A vibratory drill head mounting system, comprising:

a drill head carriage;

a vibratory drill head; and an elastomeric isolator that connects the vibratory drill head to the drill head carriage and provides an interface that allows vertical displacement of the drill head relative to the carriage, isolates vibrations of the drill head from the drill head carriage, and accommodates misalignment between the drill head carriage and a drill rod string;

wherein said drill head carriage comprises first and second vertically aligned parallel rods, and wherein said elastomeric isolator comprises first and second elastomeric isolator assemblies coupled with the first and second rods, respectively;

wherein said isolator assemblies each comprises at least one journal bearing that allows vertical sliding movement of the isolator assembly along a respective one of said rods: and wherein said elastomeric isolator assemblies each comprises an inner structure connected to said journal bearing, an outer structure connected to said drill head, and an elastomeric member connected between said inner and outer structures.

2. The vibratory drill head mounting system according to claim 1, wherein said drill head comprises a sine generator for imparting vertical vibrations to the drill rod string.

3. The vibratory drill head mounting system according to claim 2, wherein said drill head further comprises a rotation mechanism for rotating the drill rod string.

4. The vibratory drill head mounting system according to claim 3, wherein said sine generator and said rotation mechanism are coupled by a flexible elastomeric torsion coupling.

5. The vibratory drill head mounting system according to claim 4, wherein said flexible elastomeric torsion coupling comprises a first attachment structure associated with the rotation mechanism, a second attachment structure associated with the sine generator, and an annular elastomeric flexible torsion element interconnecting the first and second attachment structures.

6. The vibratory drill head mounting system according to claim 5, wherein said flexible torsion element comprises an annular body of elastomeric material, a generally arcuate transverse cross sectional shape, radially inwardly extending side walls, and an axial split extending through said body.

7. The vibratory drill head mounting system according to claim 5, wherein said first and second attachment structures each comprises a clamping means for clamping a side wall edge of said flexible torsion element.

8. The vibratory drill head mounting system according to claim 1, wherein said rotation mechanism further comprises first and second stabilizer arms coupled with the first and second rods, respectively.

9. The vibratory drill head mounting system according to claim 8, wherein said stabilizer arms each comprises at least one journal bearing that allows vertical sliding movement of the stabilizer arm along a respective one of said first and second rods.

10. The vibratory drill head mounting system according to claim 9, further comprising first and second elastomeric spacers placed between the sine generator and the rotation mechanism to support a vertical load of the rotation mechanism on top of the sine generator and to maintain a proper spacing between the sine generator and the rotation mechanism.

11. The vibratory drill head mounting system according to claim 10, wherein said first and second elastomeric spacers are concentric to the parallel rods and are located between the sine generator and the stabilizer arms of the rotation mechanism.

12. The vibratory drill head mounting system according to claim 1, further comprising a plurality of elastomeric bumpers mounted to the drill head carriage for confining the vibratory drill head within upper and lower limits of vertical movement along the parallel rods.

13. A vibratory drill head mounting system, comprising:

a drill head carriage;

a vibratory drill head having a sine generator and a rotation mechanism for imparting vibration and rotation to a drill rod string;

a first means for coupling the rotation mechanism to the sine generator that allows rotational force to be imparted by the rotation mechanism to the drill rod string while isolating vibrations of the sine generator from the rotation mechanism; and a second means for coupling the drill head to the drill head carriage that allows floating vertical movement of the drill head relative to the drill head carriage in a vertical direction while isolating vibrations of the sine generator from the drill head carriage;

wherein said drill head carriage comprises first and second vertically aligned parallel rods, and wherein said second means for coupling comprises first and second elastomeric isolator assemblies coupled with the first and second rods, respectively;

wherein said isolator assemblies each comprises at least one journal bearing that allows vertical sliding movement of the isolator assembly along a respective one of said rods; and wherein said elastomeric isolator assemblies each comprises an inner structure connected to said journal bearing, an outer structure connected to said sine generator, and an elastomeric member connected between said inner and outer structures.

14. The vibratory drill head mounting system according to claim 13, wherein said first means for coupling comprises a flexible elastomeric torsion coupling having a first attachment structure associated with the rotation mechanism, a second attachment structure associated with the sine generator, and an annular elastomeric flexible torsion element interconnecting the first and second attachment structures.

15. The vibratory drill head mounting system according to claim 14, wherein said flexible torsion element comprises an annular body of elastomeric material, a generally arcuate transverse cross sectional shape, radially inwardly extending side walls, and an axial split extending through said body.

16. The vibratory drill head mounting system according to claim 13, wherein said rotation mechanism further comprises first and second stabilizer arms coupled with the first and second rods, respectively.

17. The vibratory drill head mounting system according to claim 16, wherein said stabilizer arms each comprises at least one journal bearing that allows vertical sliding movement of the stabilizer arm along a respective one of said first and second rods.

18. The vibratory drill head mounting system according to claim 17, further comprising first and second elastomeric spacers placed between the sine generator and the rotation mechanism to support a vertical load of the rotation mechanism on top of the sine generator and to maintain a proper spacing between the sine generator and the rotation mechanism.

19. The vibratory drill head mounting system according to claim 18, wherein said first and second elastomeric spacers are each concentric to a respective one of the parallel rods and are located between the sine generator and the stabilizer arms of the rotation mechanism.

20. The vibratory drill head mounting system according to claim 13, further comprising a plurality of elastomeric bumpers mounted to the drill head carriage for confining the vibratory drill head within upper and lower limits of vertical movement along the parallel rods.

21. The vibratory drill head mounting system according to claim 13, further comprising first and second elastomeric spacers placed between the sine generator and the rotation mechanism to support a vertical load of the rotation mechanism on top of the sine generator and to maintain a proper spacing between the sine generator and the rotation mechanism.

22. A vibratory drill head mounting system, comprising:

a drill head carriage having first and second vertically aligned parallel rods;

a vibratory drill head having a sine generator and a rotation mechanism for imparting vibration and rotation to a drill rod string;

a flexible elastomeric torsion coupling having a first attachment structure associated with the rotation mechanism, a second attachment structure associated with the sine generator, and an annular elastomeric flexible torsion element interconnecting the first and second attachment structures for transmitting rotational force to the drill rod string while isolating vibrations of the sine generator from the rotation mechanism; and first and second elastomeric isolator assemblies each having an outer structure connected to the sine generator, an inner structure slidably connected to a respective one of the first and second rods, and an elastomeric member connecting said inner and outer structures for allowing floating movement of the drill head relative to the carriage in a vertical direction while isolating vibrations of the sine generator from the carriage.

23. The vibratory drill head mounting system according to claim 22, wherein said isolator assemblies each comprises at least one journal bearing that allows vertical sliding movement of the isolator assembly along a respective one of said rods.

24. The vibratory drill head mounting system according to claim 22, wherein said rotation mechanism further comprises first and second stabilizer arms coupled with the first and second rods, respectively.

25. The vibratory drill head mounting system according to claim 24, wherein said stabilizer arms each comprises at least one journal bearing that allows vertical sliding movement of the stabilizer arm along a respective one of said first and second rods.

26. The vibratory drill head mounting system according to claim 25, further comprising first and second elastomeric spacers placed between the sine generator and the rotation mechanism to support a vertical load of the rotation mechanism on top of the sine generator and to maintain a proper spacing between the sine generator and the rotation mechanism.

27. The vibratory drill head mounting system according to claim 26, wherein said first and second elastomeric spacers are each concentric to a respective one of the parallel rods and are located between the sine generator and the stabilizer arms of the rotation mechanism.

28. The vibratory drill head mounting system according to claim 22, further comprising a plurality of elastomeric bumpers mounted to the drill head carriage for confining the vibratory drill head within upper and lower limits of vertical movement along the parallel rods.

* * * * *